US007422530B1

(12) United States Patent
Olaveson

(10) Patent No.: US 7,422,530 B1
(45) Date of Patent: Sep. 9, 2008

(54) GOLF STICK

(76) Inventor: James Olaveson, 164 Loma Dr., Camarillo, CA (US) 93010

( * ) Notice: Subject to any disclaimer, the term of this patent is extended or adjusted under 35 U.S.C. 154(b) by 0 days.

(21) Appl. No.: 10/903,019

(22) Filed: Jul. 30, 2004

(51) Int. Cl.
*A63B 57/00* (2006.01)
*A63B 47/02* (2006.01)

(52) U.S. Cl. ..... 473/386; 294/19.2

(58) Field of Classification Search ..... 473/386, 473/284, 286; 294/19.2
See application file for complete search history.

(56) References Cited

U.S. PATENT DOCUMENTS 2,116,651 A * 5/1938 Ackerson ..... 473/286
2,606,764 A * 8/1952 Mason ..... 473/386
4,253,668 A 3/1981 Ose
4,360,199 A 11/1982 Jackson
4,466,650 A * 8/1984 Roedel ..... 294/19.2
5,165,744 A * 11/1992 Vogrin ..... 294/19.2
5,171,010 A 12/1992 Lanoue
5,718,646 A * 2/1998 Brewer ..... 473/386
6,743,113 B2 * 6/2004 Pettinga et al. ..... 473/286
2002/0132680 A1 * 9/2002 Ly ..... 473/286

* cited by examiner

*Primary Examiner*—Steven Wong

(57) ABSTRACT

A golf ball and tee placing aide for permitting a golfer to place a tee and ball into a teeing position without having to bend over includes an elongated tubular housing having a tee placement end and a ball placement end. The tee placement end includes a retaining assembly that automatically releases the golf tee upon insertion of the tee into the ground. A ball retaining assembly extends through the tubular housing to permit release of a golf ball by manipulation of a trigger mechanism remote from the ball placement end to permit placement of a golf ball on a golf tee while in an upright position.

10 Claims, 6 Drawing Sheets

GOLF STICK

I. BACKGROUND OF THE INVENTION

The present invention relates to golf accessories and more particularly pertains to a new golf ball and tee placing aide for permitting a golfer to place a tee and ball into a teeing position without having to bend over.

II. DESCRIPTION OF THE PRIOR ART

The use of golf accessories is known in the prior art. U.S. Pat. No. 4,360,199 issued to Jackson on Nov. 23, 1982 describes a placement device having a tee magazine but still requiring significant bending by a golfer using the device. Another type of golf accessories is U.S. Pat. No. 5,171,010 issued to Lanoue on Dec. 15, 1992 disclosing a placement aide using a bulky pivoting housing and ejector rod assembly. U.S. Pat. No. 4,253,668 issued to Ose on Mar. 3, 1981 discloses a ball receiving apparatus engageable to a complex stationary teeing device to facilitate picking up golf balls and repeatedly teeing them on the stationary teeing device.

While these devices fulfill their respective, particular objectives and requirements, the need remains for a relatively simple device that obviates any need to bend over to both insert a conventional golf tee and place a golf ball upon the inserted tee.

III. SUMMARY OF THE INVENTION

The present invention generally comprises an elongated tubular housing having a tee placement end and a ball placement end. The tee placement end includes a retaining assembly that automatically releases the golf tee upon insertion of the tee into the ground. A ball retaining assembly extends through the tubular housing to permit release of a golf ball by manipulation of a trigger mechanism remote from the ball placement end to permit placement of a golf ball on a golf tee while in an upright position.

There has thus been outlined, rather broadly, the more important features of a golf ball and tee placing aide in order that the detailed description thereof that follows may be better understood, and in order that the present contribution to the art may be better appreciated. There are additional features of the golf ball and tee placing aide that will be described hereinafter and which will form the subject matter of the claims appended hereto.

In this respect, before explaining at least one embodiment of the golf ball and tee placing aide in detail, it is to be understood that the golf ball and tee placing aide is not limited in its application to the details of construction and to the arrangements of the components set forth in the following description or illustrated in the drawings. The golf ball and tee placing aide is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present golf ball and tee placing aide. It is important, therefore, that the claims be regarded as including such equivalent constructions insofar as they do not depart from the spirit and scope of the present invention.

It is another object of the present invention to provide a golf ball and tee placing aide which has all of the advantages of the prior art and none of the disadvantages.

It is another object of the present invention to provide a golf ball and tee placing aide which may be easily and efficiently manufactured and marketed.

It is another object of the present invention to provide a golf ball and tee placing aide which is of durable and reliable construction.

It is yet another object of the present invention to provide a golf ball and tee placing aide which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
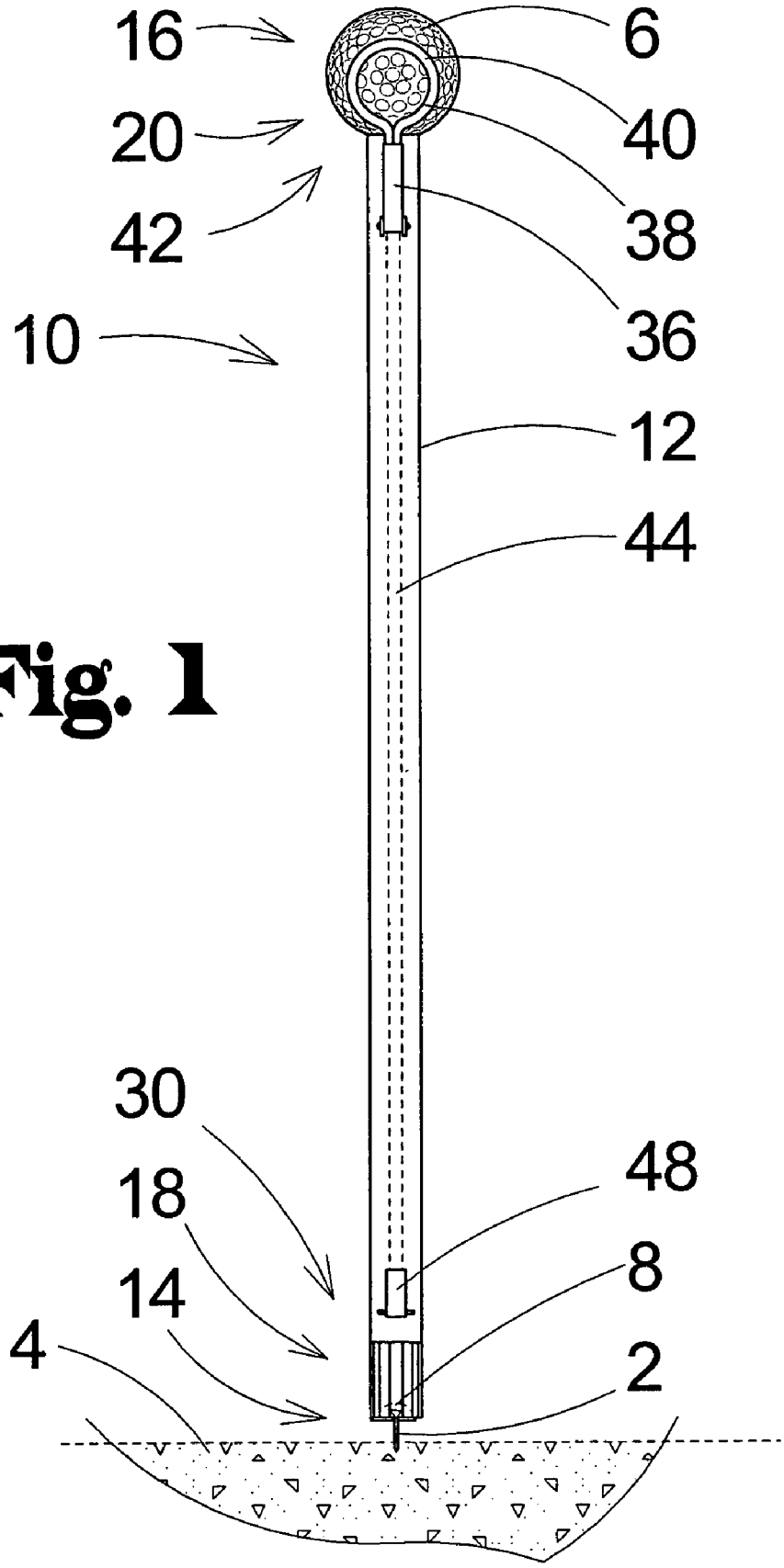
FIG. 1 is a perspective view of a new golf ball and tee placing aide according to the present invention.
Figure 2:
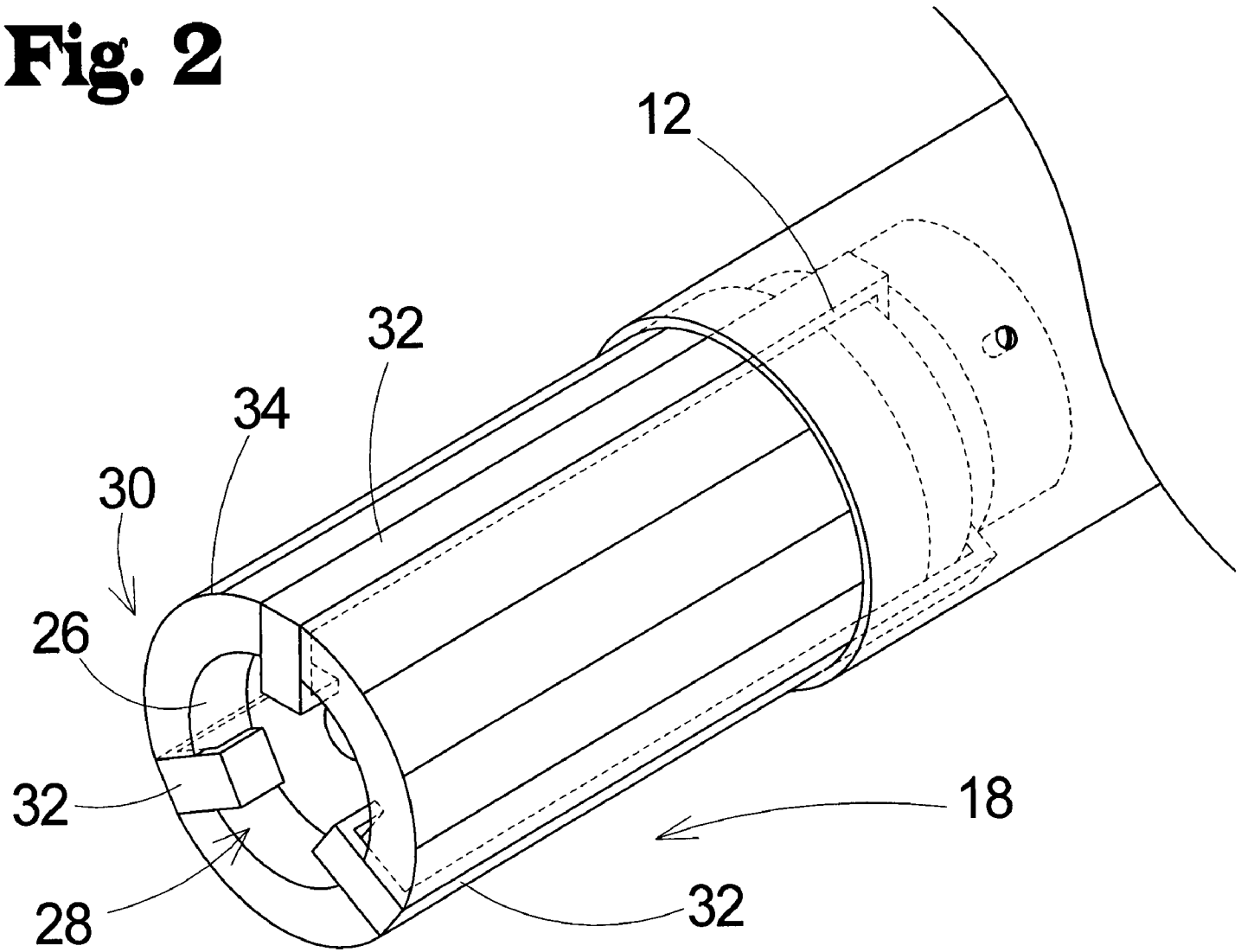
FIG. 2 is a perspective end view of the tee placement end of the present invention.
Figure 3:
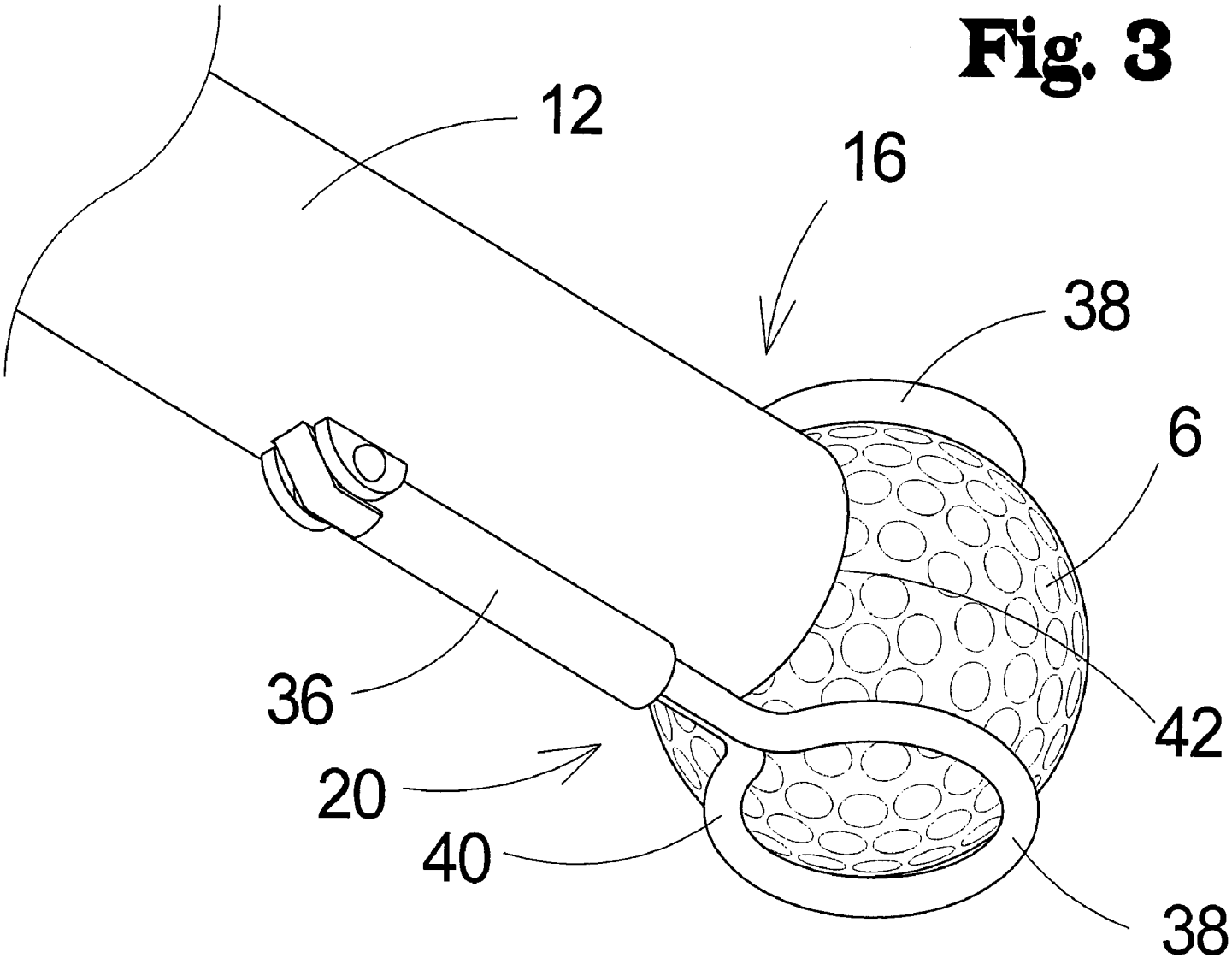
FIG. 3 is a perspective view of the ball placement end of the present invention.
Figure 4:
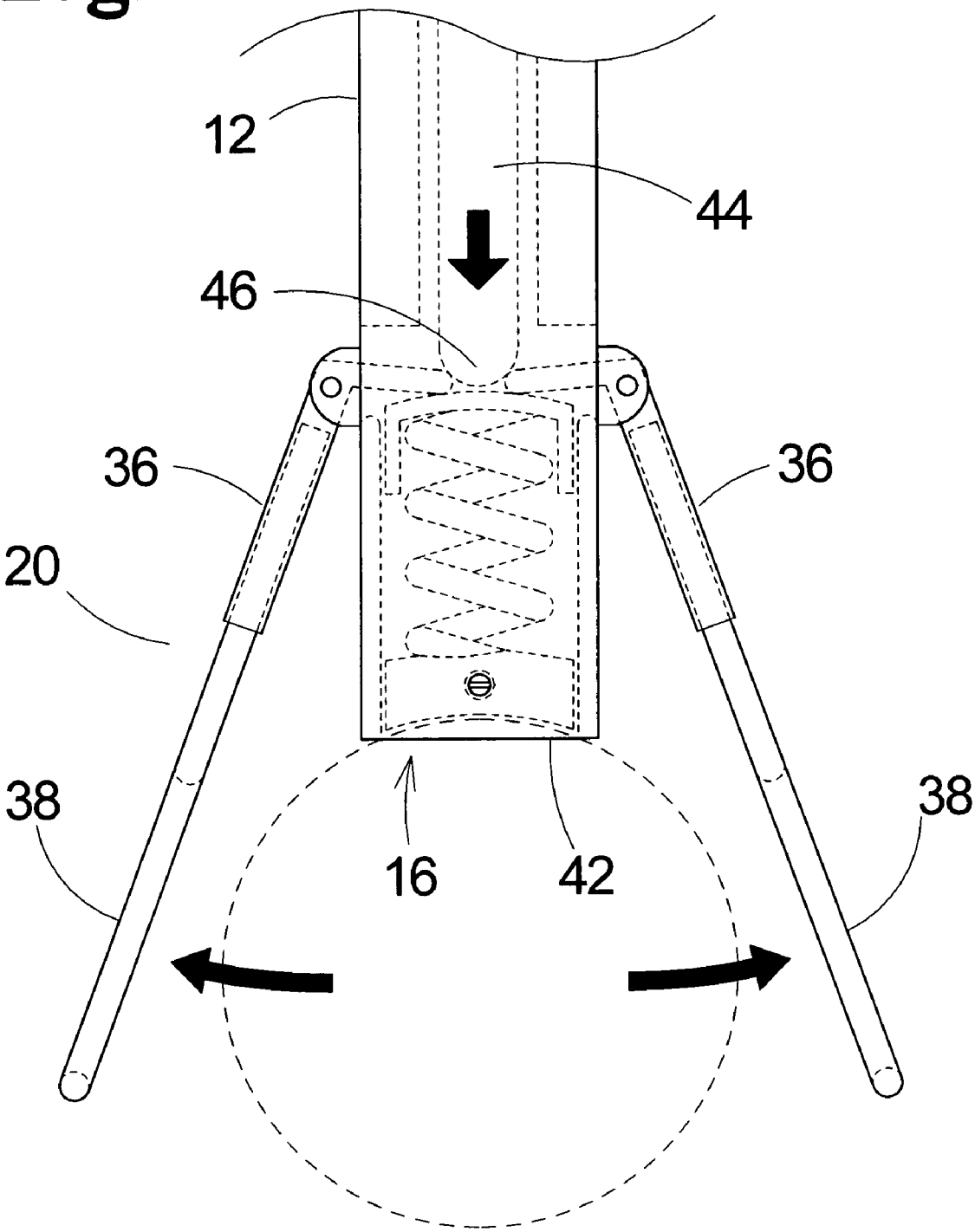
FIG. 4 is a partial cut-away front view of the ball placement end of the present invention.
Figure 5:
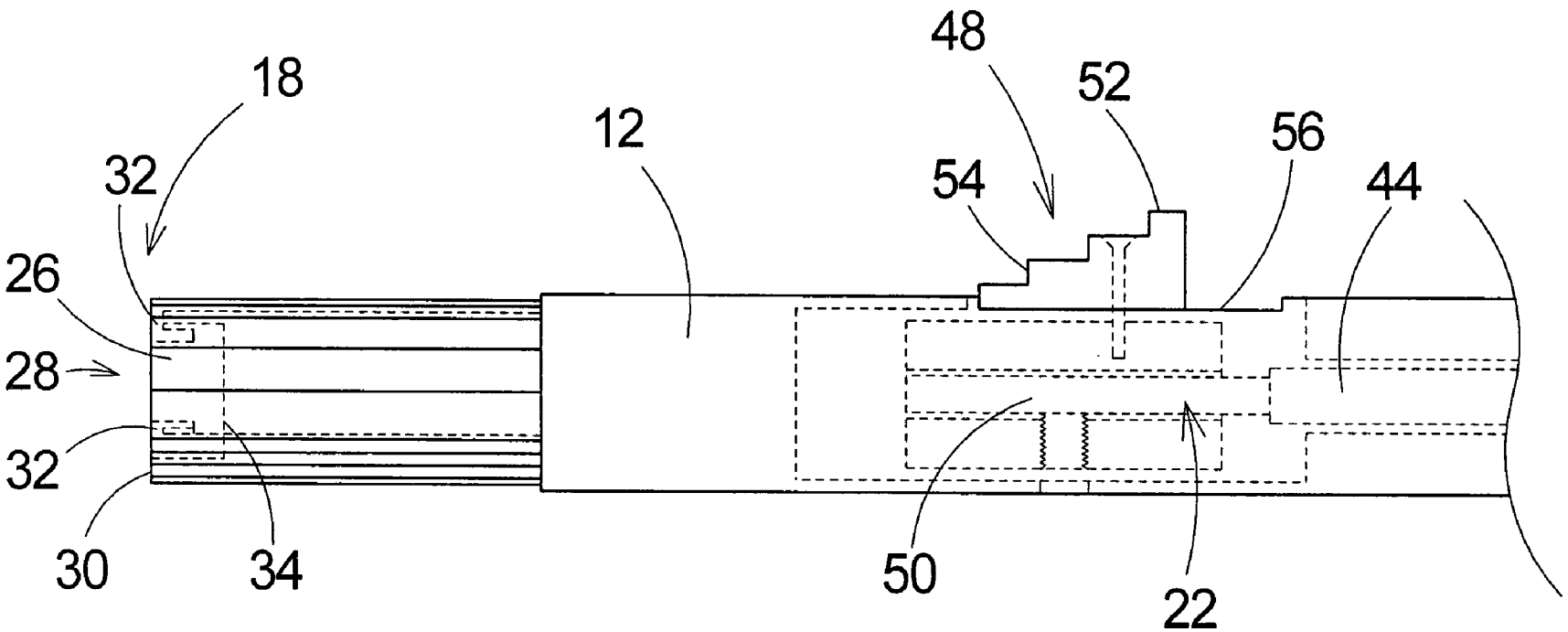
FIG. 5 is a partial cut-away side view of the tee placement end of the present invention.
Figure 6:
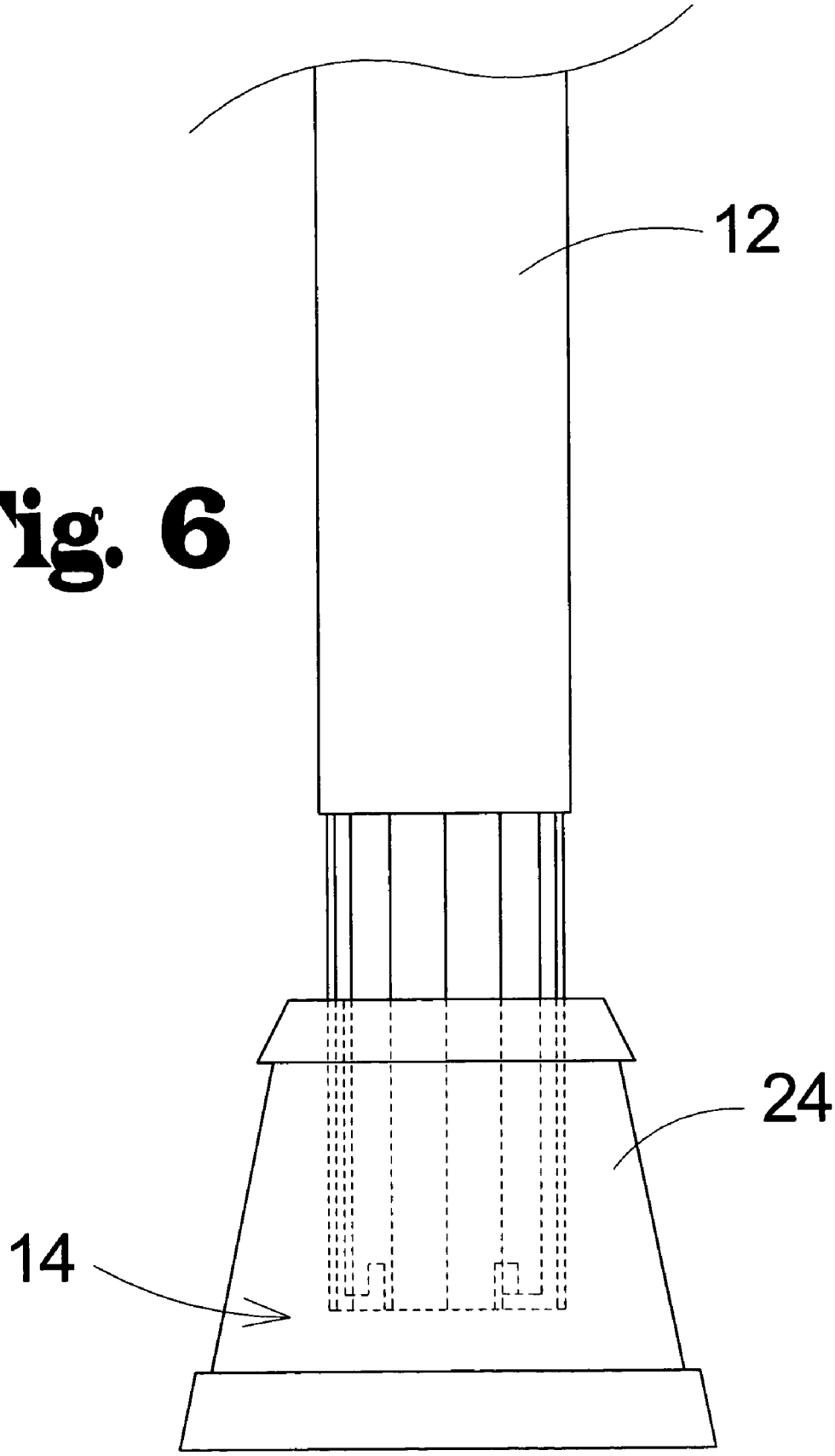
FIG. 6 is a front view of the covered tee placement end of the present invention.

With reference now to the drawings, and in particular to FIGS. 1 through 6 thereof, a new golf ball and tee placing aide embodying the principles and concepts of the present invention and generally designated by the reference numeral 10 will be described.

As best illustrated in FIGS. 1 through 6, the golf ball and tee placing aide 10 generally comprises an elongated tubular housing 12 having a tee placement end 14 and a ball placement end 16. The elongated tubular housing has a constant diameter from the tee placement end to the ball placement end. A tee retaining assembly 18 is operationally coupled to the tee placement end 14 such that a golf tee 2 is released from the tee placement end 14 upon insertion of the tee 2 into a ground surface 4. A ball retaining assembly 22 extends through the tubular housing 12. A trigger mechanism 22 is operationally coupled to the ball retaining assembly 20 to permit release of a golf ball 6 from the ball retaining assembly 20 by manipulation of the trigger mechanism 22. The trigger mechanism 22 is positioned proximate the tee placing end 14 for facilitating placement of the golf ball 6 on the tee 2 while the golfer remains in an upright position.

Optionally, a rubber cover member 24 or cup is positionable over the tee placement end 14. Thus, the tubular housing member 12 is additionally designed for use as a walking aide.

The tee placement end 14 more specifically includes a depression 26 in a medial portion 28 of a first end 30 of the tubular housing 12. A plurality of tabs 32 extend inwardly from an outer edge 34 of the depression 26 for engaging the tee 2 when a head portion 8 of the tee 2 is inserted into the depression 26. Preferably, three tabs spaced evenly about the depression 26 are used. The tabs 32 are resilient or pivotal for releasing the head portion 8 of the tee 2 when the tubular housing 12 is pulled away from the tee 2 after insertion of the tee 2 into the ground surface 4. To achieve this release, friction between the tee 2 and the ground exceeds the retaining force exerted on the tee by the tabs 32.

The ball retaining assembly 20 more specifically includes a pair of opposing arms 36 pivotally coupled to the ball placement end 16 of the tubular housing 12. The trigger mechanism 22 is operationally coupled to the opposing arms 36 for selectively pivoting the opposing arms 36. A pair of ball engaging members 38 extend from the opposing arms 36 for engaging the golf ball 6 when the opposing arms 36 are in a closed position. Each of the ball engaging members 38 includes an annular portion 40 positioned to extend from a second end 42 of the tubular housing 12 such that the golf ball 6 is positioned directly against the second end 42 of the tubular housing 12 when the golf ball 6 is held by the ball engaging members 38.

The trigger mechanism 22 includes an extension member 44 extending through an interior 46 of the tubular housing 12. The extension member 44 has a first end 46 coupled to the opposing arms 36. Thus, the opposing arms 36 pivot upon movement of the extension member 44 through the tubular housing 12. A trigger member 48 is coupled to a second end 50 of the extension member 44 for moving the extension member 44 through the tubular housing 12 upon manipulation of the trigger member 48.

In an embodiment, the trigger member 48 is a button 52 slidable with respect to the tubular housing 12 proximate the tee placement end 14 of the tubular housing 12. The trigger member 48 is operationally coupled to the extension member whereby sliding of the trigger member 48 with respect to the tubular housing 12 actuates the opposing arms 36 to release the golf ball 6.

In use, a tee is placed into the tee placement end of the tubular housing and a downward motion is used to insert the tee into the ground. A golf ball is loaded into the ball retaining assembly. The golf ball is then positioned on or just over the tee and the trigger member is manipulated to release the golf ball onto the tee. The user may then play the golf ball off of the tee. If desired, the user may place the cover member over the tee placement end and use the device as a walking aid.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf ball and tee placing aide comprising:

an elongated tubular housing having a tee placement end and a ball placement end, the elongated housing having a constant diameter from the tee placement end to the ball placement end, a tee retaining assembly operationally coupled to said tee placement end such that a golf tee is released from said tee placement end upon insertion of the tee into a ground surface, a ball retaining assembly extending through said tubular housing, the ball retaining assembly having a pair of opposing arms pivotally coupled to said ball placement end of said tubular housing, wherein said trigger mechanism is operationally coupled to said opposing arms for selectively pivoting said opposing arms, and a pair of ball engaging members extending from said opposing arms for engaging the golf ball when said opposing arms are in a closed position, and a trigger mechanism operationally coupled to said ball retaining assembly to permit release of a golf ball from said ball retaining assembly by manipulation of said trigger mechanism;

wherein the ball rests directly against the ball placement end of the elongated tubular housing when the ball is positioned within the ball retaining assembly.

2. The golf ball and tee placing aide of claim 1 wherein said trigger mechanism is positioned proximate said tee placing end for facilitating placement of the golf ball on the tee while in an upright position.

3. The golf ball and tee placing aide of claim 1, further comprising a cover member positionable over said tee placement end whereby said tubular housing member is adapted for use as a walking aide.

4. The golf ball and tee placing aide of claim 1 wherein said tee placement end comprises:

a depression in a medial portion of a first end of said tubular housing, a plurality of tabs extending inwardly from an outer edge of said depression for engaging the tee when a head portion of the tee is inserted into the depression.

5. The golf ball and tee placing aide of claim 4 wherein said tabs are resilient for releasing the head portion of the tee when the tubular housing is pulled away from the tee after insertion of the tee into the ground surface.

6. The golf ball and tee placing aide of claim 1 wherein each of said ball engaging members includes an annular portion positioned to extend from a second end of said tubular housing such that the golf ball is positioned adjacent to said second end of said tubular housing when the golf ball is held by said ball engaging members.

7. The golf ball and tee placing aide of claim 1 wherein said trigger mechanism includes an extension member extending through an interior of said tubular housing, said extension member having a first end coupled to said opposing arms whereby said opposing arms pivot upon movement of said extension member through said tubular housing, and further wherein said extension member further comprises a trigger member coupled to a second end of said extension member for moving said extension member through said tubular housing upon manipulation of said trigger member.

8. The golf ball and tee placing aide of claim 7 wherein said trigger member is a button slidable with respect to said tubular housing proximate said tee placement end of said tubular housing.

9. The golf ball and tee placing aide of claim 8 wherein said trigger member is operationally coupled to said extension member such that sliding of said trigger member with respect to said tubular housing actuates said opposing arms to release the golf ball.

10. A golf ball and tee placing aide comprising:

an elongated tubular housing having a tee placement end and a ball placement end, the elongated housing having a constant diameter from the tee placement end to the ball placement end, a tee retaining assembly operationally coupled to said tee placement end such that a golf tee is released from said tee placement end upon insertion of the tee into a ground surface, a ball retaining assembly extending through said tubular housing, a trigger mechanism operationally coupled to said ball retaining assembly to permit release of a golf ball from said ball retaining assembly by manipulation of said trigger mechanism, wherein said trigger mechanism is positioned proximate to said tee placing end for facilitating placement of the golf ball on the tee while in an upright position, a cover member positionable over said tee placement end whereby said tubular housing member is adapted for use as a walking aide, a depression in a medial portion of a first end of said tubular housing, a plurality of tabs extending inwardly from an outer edge of said depression for engaging the tee when a head portion of the tee is inserted into the depression, wherein said tabs are resilient for releasing the head portion of the tee when the tubular housing is pulled away from the tee after insertion of the tee into the ground surface, wherein said ball retaining assembly comprises (i) a pair of opposing arms pivotally coupled to said ball placement end of said tubular housing, wherein said trigger mechanism is operationally coupled to said opposing arms for selectively pivoting said opposing arms, and (ii) a pair of ball engaging members extending from said opposing arms for engaging the golf ball when said opposing arms are in a closed position, wherein each of said ball engaging members includes an annular portion positioned to extend from a second end of said tubular housing such that the golf ball is positioned adjacent to said second end of said tubular housing when the golf ball is held by said ball engaging members, wherein said trigger mechanism includes an extension member extending through an interior of said tubular housing, said extension member having a first end coupled to said opposing arms whereby said opposing arms pivot upon movement of said extension member through said tubular housing, a trigger member coupled to a second end of said extension member for moving said extension member through said tubular housing upon manipulation of said trigger member, wherein said trigger member is a button slidable with respect to said tubular housing proximate said tee placement end of said tubular housing, and further wherein said trigger member is operationally coupled to said extension member such that sliding of said trigger member with respect to said tubular housing actuates said opposing arms to release the golf ball;

wherein the ball rests directly against the ball placement end of the elongated tubular housing when the ball is positioned within the ball retaining assembly.

* * * * *